United States Patent [19]

Torppey

[11] Patent Number: 5,027,482

[45] Date of Patent: Jul. 2, 1991

[54] SECURING DEVICE FOR SHOES

[75] Inventor: Scott W. Torppey, Wheaton, Ill.

[73] Assignee: Central DuPage Pedorthics, Inc., Carol Stream, Ill.

[21] Appl. No.: 468,747

[22] Filed: Jan. 24, 1990

[51] Int. Cl.[5] ..... A43B 11/00

[52] U.S. Cl. ..... 24/712.1; 24/712; 24/306; 36/50

[58] Field of Search ..... 24/306, 450, 442, 712, 24/712.1, 712.2, 712.6; 36/50

[56] References Cited

U.S. PATENT DOCUMENTS

| | | | |
|---|---|---|---|
| 797,052 | 8/1905 | Falconer | 24/712 |
| 2,266,083 | 12/1941 | Rzepa | 24/267 |
| 3,279,015 | 10/1966 | Henning | 24/117 |
| 3,626,610 | 12/1971 | Dassler | 36/50 |
| 4,065,861 | 1/1978 | Pelfrey | 36/50 |
| 4,079,527 | 3/1978 | Antonious | 36/51 |
| 4,081,916 | 4/1978 | Salisbury | 36/50 |
| 4,114,297 | 9/1978 | Famolare, Jr. | 36/50 |
| 4,282,657 | 8/1981 | Antonious | 36/50 |
| 4,414,761 | 11/1983 | Mahood | 36/50 |
| 4,790,048 | 12/1988 | Arnt | 24/712.1 |
| 4,879,787 | 11/1989 | Walls | 24/712.2 |
| 4,907,352 | 3/1990 | Ginsberg | 36/50 |

FOREIGN PATENT DOCUMENTS

| | | | |
|---|---|---|---|
| 1457313 | 12/1976 | United Kingdom | 24/712.1 |

OTHER PUBLICATIONS

Two-page pamphlet entitled "ORTHO LACE—A Unique Method Of Closing Shoes . . . Using Only One Hand", manufactured by W.B.C. Industries, Westfield, N.J., Nov. date.

*Primary Examiner*—Victor N. Sakran

*Attorney, Agent, or Firm*—Tilton, Fallon, Lungmus & Chestnut

[57] ABSTRACT

A securing device for shoes includes a lace which co-operates with a shoe's eyelets, and first and second tab members secured to opposite end portions of the lace. The device may alternatively include a plurality of lace segments. The tab members include hook and loop-type strips which co-operate to releasably secure the two members together in any one of various adjusted positions.

5 Claims, 3 Drawing Sheets

FIG. 4
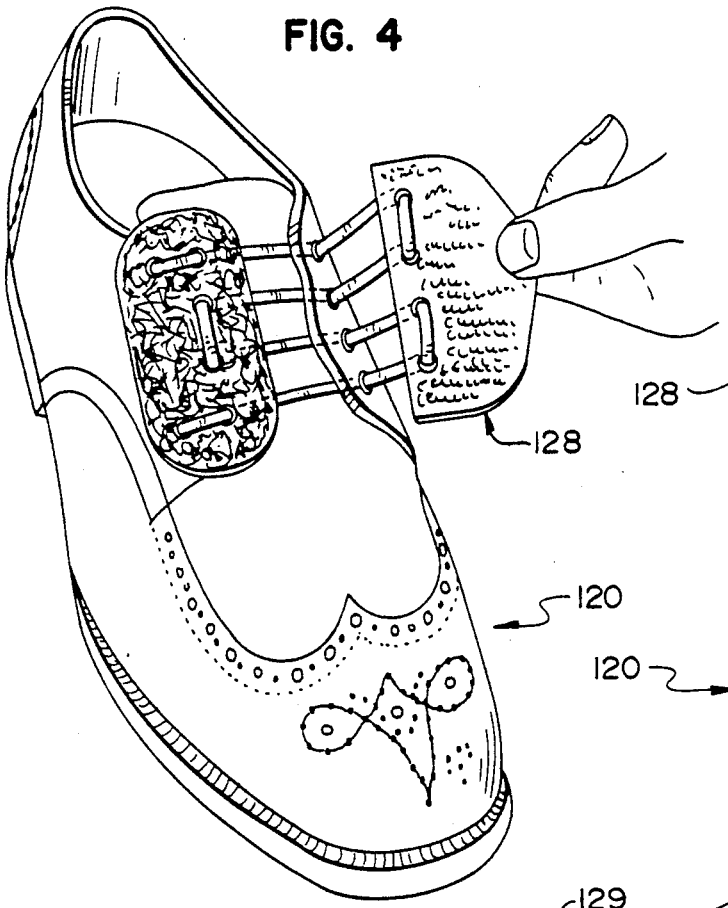
FIG. 5
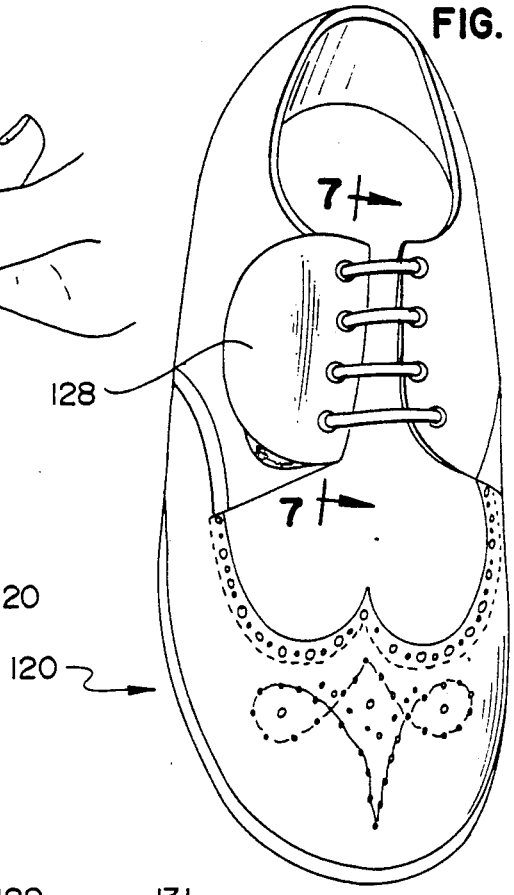
FIG. 7
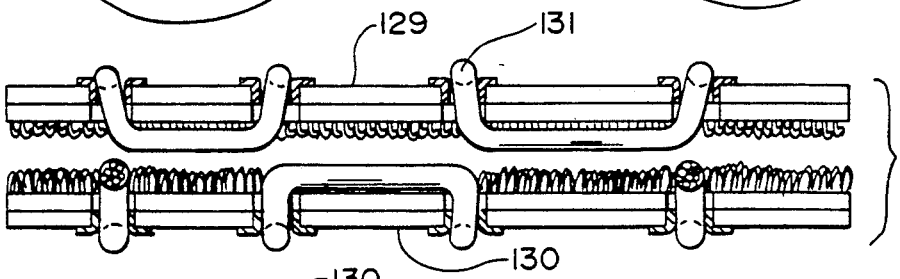
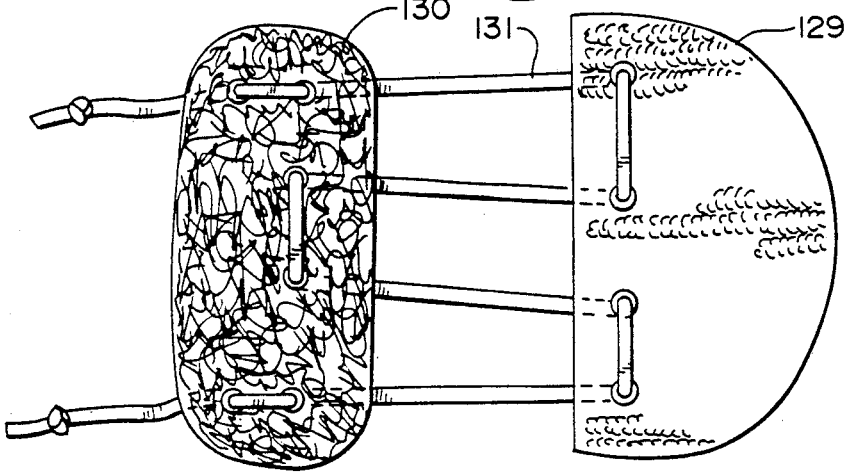
FIG. 6

SECURING DEVICE FOR SHOES

BACKGROUND OF THE INVENTION

1. Field of the Invention

The present invention relates to a securing device for lace-type shoes. More particularly, this invention relates to a securing device which a user may attach and adjust quickly and effectively.

2. Description of the Prior Art

Many shoes have a lace-type closure, including a pair of adjacent closure flaps and a lace which connects the two flaps. When taking off these shoes, a wearer first loosens the lace along a substantial portion of the closure. Conversely, when putting such a shoe on, a wearer tightens the lace along the entire closure.

The shoes described above provide a suitable closure, but they present an inconvenience. Some individuals, e.q., handicapped people and small children, cannot easily tighten and tie their closure. Others lack the patience required to properly tighten and loosen the laces. Still others, e.g., triathletes, use the shoes in situations which require that the wearer quickly put the shoes on and take them off.

The prior art includes shoes with lace-type closures designed to solve the problem or disadvantage described above. Mahood U.S. Pat. No. 4,414,761 and Salisbury U.S. Pat. No. 4,081,916 describe shoes with "quick lace tightening" closures. But the closures described present other disadvantages. For example, they require redesigning of the shoes which use them, oftentimes including the permanent fixation, e.q., sewing, of hook and loop-type strips to the body of the shoe.

The securing device of the present invention avoids the disadvantages of the prior art. It allows a user to quickly put his or her shoes on and take them off. It is a simple construction not permanently affixed to any portion of a shoe. A user may apply this construction to any lace-type shoe and may easily transfer it to other similar shoes.

SUMMARY OF THE INVENTION

In accordance with one embodiment of the present invention, a securing device for lace-type shoes includes a lace means and a first and second tab member. The securing device co-operates with the closure flaps of those shoes to secure the shoes to the feet of a user.

The lace means extends through openings in the closure flaps and connects one closure flap with the other. It includes a portion which extends between the openings of the flaps; a portion which extends through the openings of one flap and outwardly of the opening of the one flap; and a portion which extends through the opening of the other flap and outwardly of the opening of the other flap.

The first tab member lies removably secured to one of the outwardly extending portions of the lace means. The second tab member lies releasably secured to the other outwardly extending portion of the lace member. The first and second tab members include co-operating means for releasably securing the tab members together. The co-operating means extend over portions of a surface on each tab member to permit positioning of one tab relative to another in any of a plurality of fastening positions.

BRIEF DESCRIPTION OF THE DRAWINGS

For a more complete understanding of this invention, one should now refer to the embodiments illustrated in greater detail in the accompanying drawings and described below by way of examples of the invention.

In the drawings:

FIG. 4 is a perspective view of a dress shoe, including a modified form of the securing device shown in Figs. 1–3, and showing the device disposed in an open position;

FIG. 5 is perspective view of the shoe of FIG. 4, showing the securing device of the present invention disposed in a closed position;

FIG. 6 is a plan view of the modified securing device shown in FIGS. 4 and 5;

FIG. 7 is a sectional view taken along line 7—7 in FIG. 5;

While the following disclosure and the drawings describe the invention in connection with a number of embodiments, one should understand that the invention is not limited to these embodiments. Furthermore, one should understand that the drawings are not to scale. In certain instances, the disclosure may not include details which are not necessary for an understanding of the present invention.

DETAILED DESCRIPTION OF THE DRAWINGS AND EMBODIMENTS

Figure 1:
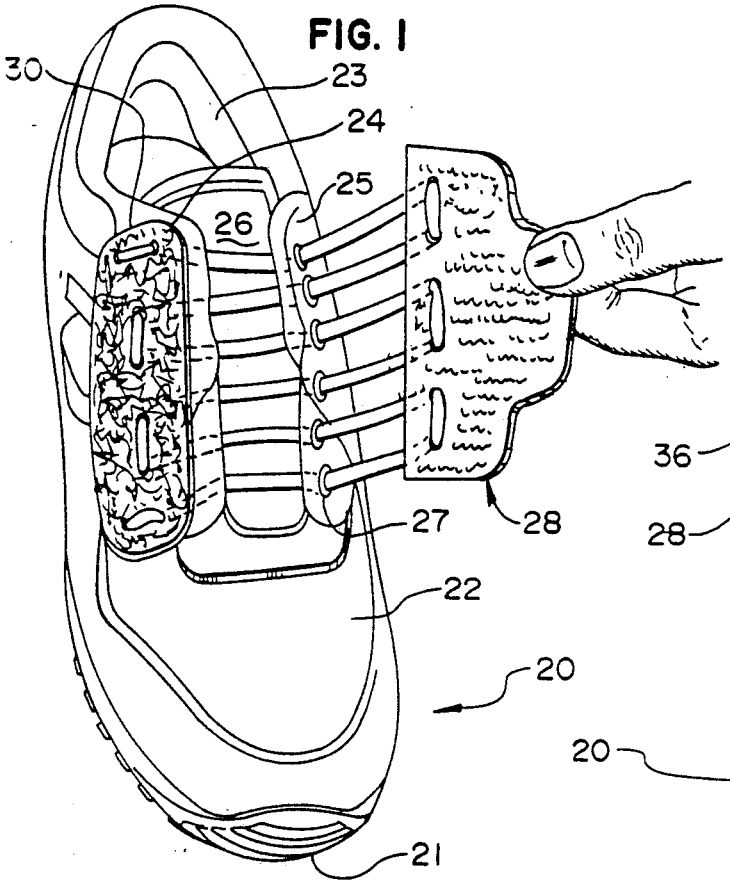
FIG. 1 is a perspective view of an athletic shoe, including the securing device of the present invention, showing the securing device in an unsecured position.
Figure 2:
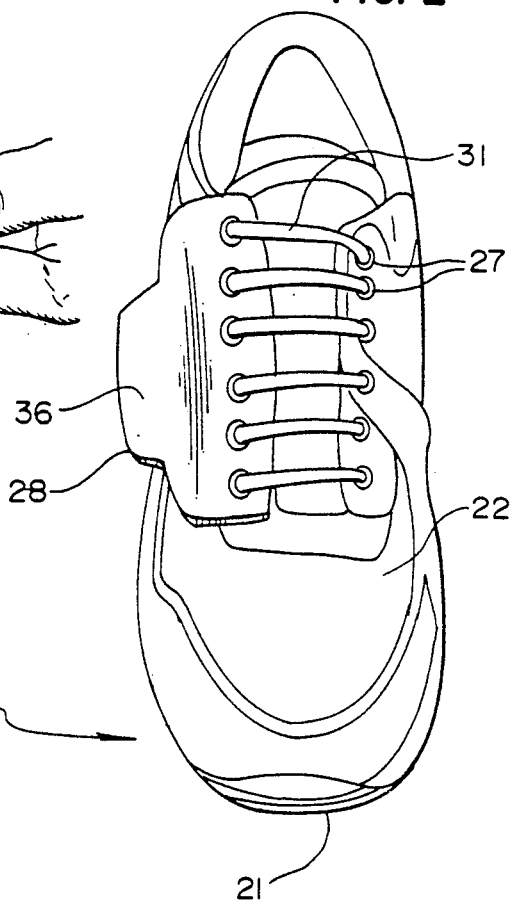
FIG. 2 is a perspective view of the athletic shoe shown in FIG. 1 with the securing device disposed in a closed position.

Turning now to the drawings, FIGS. 1 and 2 show an athletic shoe 20 including a sole portion 21 and an upper portion 22. The upper portion 22 defines an access opening 23, including an elongate portion which extends along the center of the upper. It includes closure flaps 24 and 25 which lie on opposite sides of the elongate portion of the access opening 23. It also includes tongue portion 26 subtending the closure flaps 24 and 25 and normally closing the elongate portion of opening 23. The closure flap 25 includes eyelets 27; and the closure flap 24 includes an equal number of corresponding eyelets (not shown).

A securing device 28 co-operates with the closure flaps 24 and 25 to provide a closure for the elongate portion of opening 23 and a means by which a wearer may secure the shoe 20 on his or her foot. The securing device 28 generally includes a first tab member 29, a second tab member 30 and a lace member 31 which connects the two tab members together.

The lace member 31 is an elongate leather strip or any other suitable material. It extends between the two tab members 29 and 30 in a sinuous path through openings in the tab members. The tab member 29 includes openings 32 which correspond in number and spacing with the eyelets 27; and the tab member 30 includes openings 33 which correspond in number and spacing with the eyelets in closure flap 24. The tab member 30 includes two additional openings 34 disposed at opposite ends of the tab member to secure the opposite ends of the lace member 31 to the tab member, such as by knots 31*a* and 31*b* tied in the end portions of the lace member 31.

Figure 3:
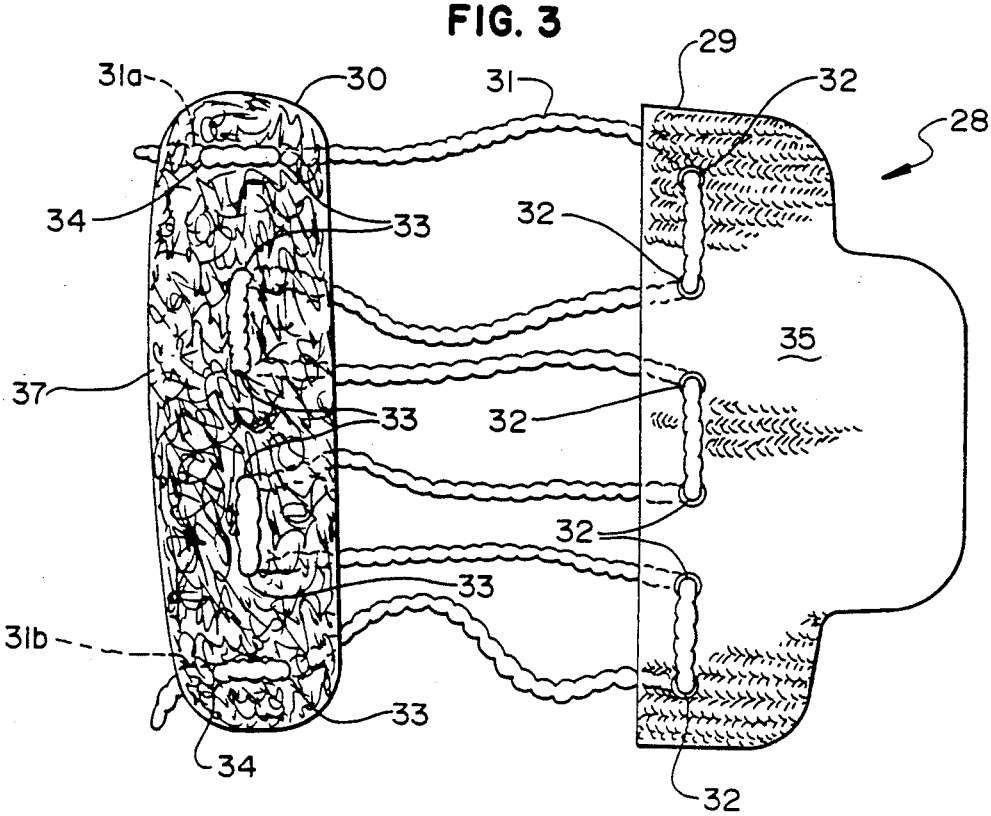
FIG. 3 is a plan view of the securing device used in FIGS. 1 and 2.
Figure 8:
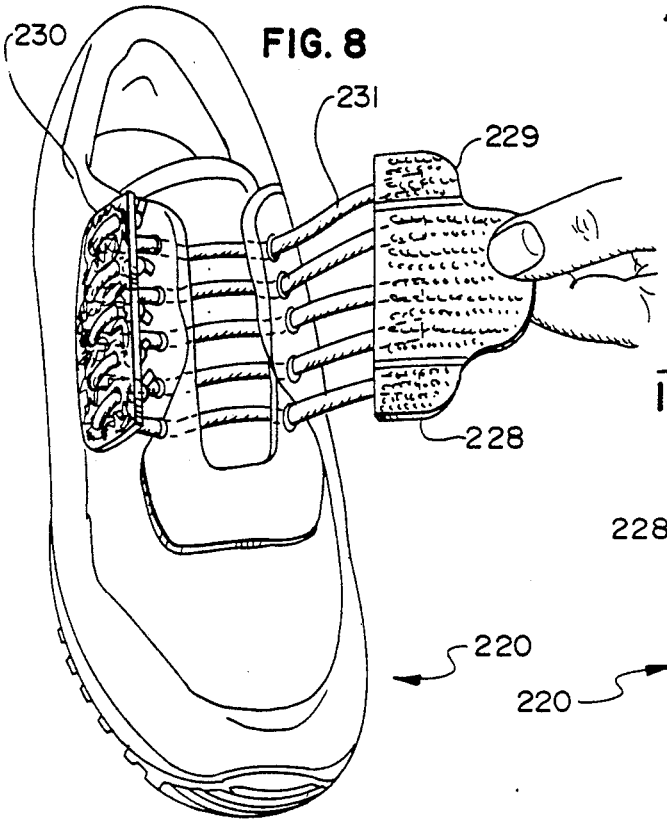
FIG. 8 is a perspective view of an athletic shoe, including a second embodiment of the securing device of the present invention.
Figure 9:
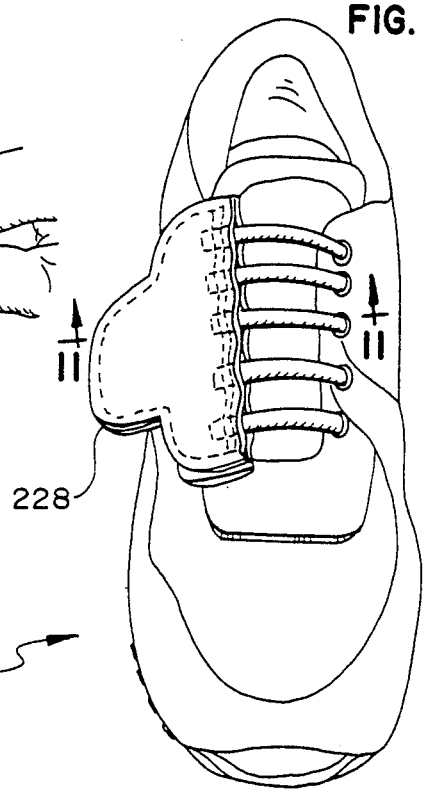
FIG. 9 is a perspective view of the athletic shoe of FIG. 8, showing the securing device disposed in a closed position.

The tab members 29 and 30 are plate-like members with a configuration shown in FIG. 3 or any other suitable configuration. The tab member 29 includes a fastener fabric 35 and a supporting layer 36 adhered or otherwise secured to the fabric 35 and made of plastic or any other suitable material of sufficient strength and stiffness. Similarly, the tab member 30 includes a supporting layer (not shown) made of the same material as layer 36 and a fastener fabric 37 adhered, stitched, or otherwise fixedly secured to the supporting layer. The fastener fabrics 35 and 37 have co-operable formations which render the fabrics mutually cohesive. An example of fabrics of this type are hook and loop fastener fabrics sold under the Trademark VELCRO.

To place the securing device 28 on the shoe 20, a user first forms a knot at one end of the lace member 31 and moves the other, opposite end of the lace member through the bottom opening 34 (at the bottom of the tab member 30 in FIG. 3) and along the path shown in FIG. 3, threading the lace through the eyelets of the closure flaps 24 and 25 as shown in FIG. 1. After moving the opposite end of the lace member through the top opening 34 (at the top of the tab member 30 in FIG. 3), the user then knots the opposite end of the lace member to detachably secure the device 28 on the shoe 20 as shown in FIG. 1.

In the position shown in FIG. 1, the securing device 28 allows the closure flaps 24 and 25 to move away from each other and increase the size of the opening 23, allowing easy movement in and out of the shoe. By moving the tab members 29 and 30 in overlapping relation (from right to left in FIG. 1) and bringing the fastener fabric 35 in contact with the fastener fabric 37, the user or wearer may force the closure flaps 24 and 25 closer together, tighten the lace 31, and thereby rapidly and adjustably secure the shoe to the wearer's foot. A user may readily transfer the securing device to any other lace-type shoe by simply untying the knots 31*a* and 31*b* at the ends of lace member 31, unlacing, and then relacing the securing device to a new pair of shoes.

FIGS. 4 and 5 illustrate a dress shoe 120 with a modified securing device 128. The securing device 128 includes a first tab member 129, a second tab member 130, and a lace member 131 made of the same material as corresponding elements of the securing device 28. The tab member 129 includes a hook and loop-type fabric with male elements; and the tab member 130 includes a hook and loop-type fabric with female elements.

The closure flaps of the shoe 120 have fewer eyelets. However, since they have an even number of eyelets (as do the closure flaps of the shoe 20), the knots at the ends of the lace member 131 may lie below the tab member 130 as shown in FIG. 6. Alternatively, the shoe 120 may include an odd number of eyelets at each closure flap. In this alternative, one of the ends of the lace member 131 would terminate at the tab member 129 and the other at the tab member 130.

FIGS. 8–11 illustrate a shoe 220 with another embodiment 228 of the securing device of the present invention. This securing device includes a first tab member 229 and a second tab member 230. It also includes lace segments 231 adhered, stitched, or otherwise fixedly secured at one end to the first tab member 229 and releasably secured at the opposite end to tab member 230. The lace segments 231 correspond in number and spacing with the eyelets in the closure flaps of the shoe 220.

Figure 10:
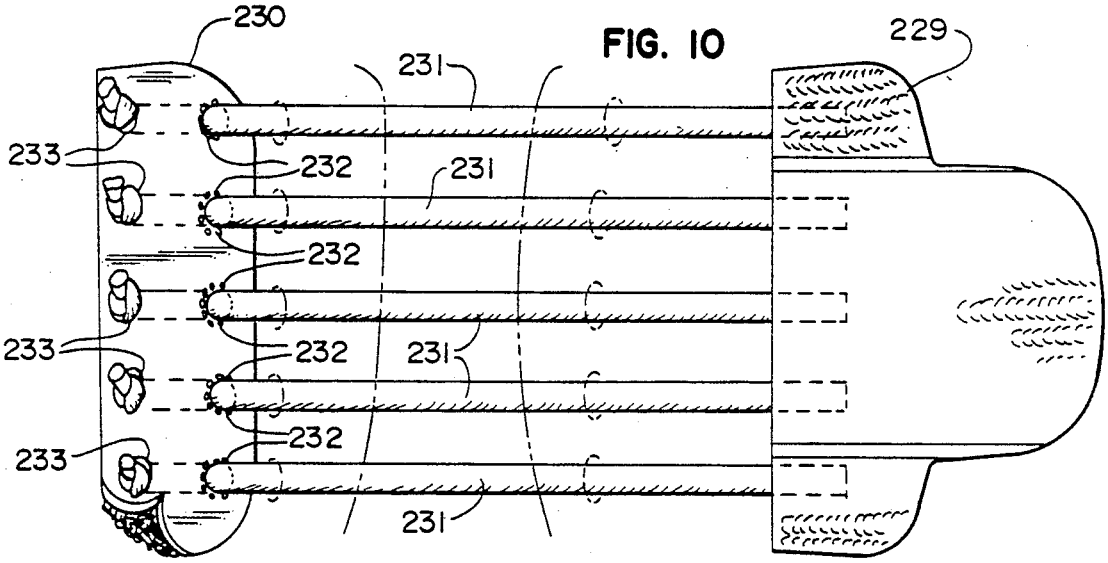
FIG. 10 is a plan view of the securing device shown in FIGS. 8 and 9.
Figure 11:
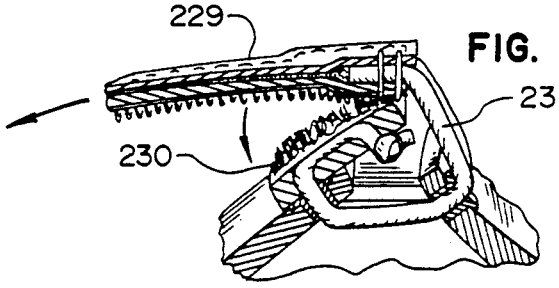
FIG. 11 is a sectional view taken along line 11—11 in FIG. 9.

The tab member 230 includes pairs of openings 232 and 233 (as shown in FIG. 10) for each lace segment. These openings facilitate the securing of the opposite ends of the lace segments 231 to the tab member 230 and placing of the knots which secure the lace segments to the tab member 230, on the side of the tab member opposite the face which includes the fastener fabric. The shoe 220 includes flaps with an odd number of eyelets; and accordingly, the securing member 228 has a corresponding odd number of lace segments 231.

While the above description and the drawings disclose and illustrate two embodiments and a modification of one embodiment, one should understand, of course, that the invention is not limited to these embodiments and modification. Those skilled in the art to which the invention pertains may make modifications and other embodiments employing the principles of this invention, particularly upon considering the foregoing teachings. Therefore, by the appended claims, the applicant intends to cover any such modifications and other embodiments as incorporate those features which constitute the essential features of this invention.

What is claimed is:

1. A securing device for a shoe having a pair of adjacent closure flaps, each flap defining at least one opening, said device comprising: lace means for connecting one closure flap with the other, said lace means including a portion for extending between the openings of the flaps, a portion for extending through the opening of one flap and outwardly of the opening of the one flap, and a portion for extending through the opening of the other flap and outwardly of the opening of the other flap; a first tab member secured to one outwardly extending portion of the lace means; a second tab member secured to the other outwardly extending portion of the lace means; said first and second tab members including co-operating means for releasably securing the tab members together; said first and second tab members being moveable relative to said shoe.

2. The securing device of claim 1, wherein the lace means is a continuous lace member.

3. The securing device of claim 2, wherein each closure flap defines a plurality of openings, each tab member defines a plurality of openings, and the lace member lies disposed in a sinuous configuration between the openings in the closure flaps and in the tab members.

4. The securing device of claim 1, wherein each closure flap defines a plurality of openings and the lace means includes a plurality of lace segments, each segment having two ends, one end of each segment being secured to the first tab member and the other, opposite end of each segment being secured to the second tab member.

5. The securing device of claim 1, wherein the co-operating means includes hook and loop-type segments.

* * * * *